US011591868B1

(12) United States Patent
Perez et al.

(10) Patent No.: US 11,591,868 B1
(45) Date of Patent: Feb. 28, 2023

(54) HIGH G FORCE VIBRATORY SEPARATOR SYSTEM

(71) Applicants: Octavio Perez, Houston, TX (US); Ben Hiltl, Houston, TX (US)

(72) Inventors: Octavio Perez, Houston, TX (US); Ben Hiltl, Houston, TX (US)

( * ) Notice: Subject to any disclaimer, the term of this patent is extended or adjusted under 35 U.S.C. 154(b) by 0 days.

(21) Appl. No.: 17/493,676

(22) Filed: Oct. 4, 2021

(51) Int. Cl.
*E21B 21/06* (2006.01)
*B07B 1/42* (2006.01)
*B07B 1/46* (2006.01)

(52) U.S. Cl.
CPC ..... *E21B 21/065* (2013.01); *B07B 1/42* (2013.01); *B07B 1/46* (2013.01); *B07B 2230/01* (2013.01)

(58) Field of Classification Search
CPC ..... B07B 1/42; B07B 1/46; B07B 2230/01; E21B 21/065
See application file for complete search history.

(56) References Cited

U.S. PATENT DOCUMENTS 3,899,414 A 8/1975 Hansen
5,232,099 A * 8/1993 Maynard ..... B07B 1/42 209/276
6,269,953 B1 8/2001 Seyffert
6,401,934 B1 6/2002 Largent
6,439,391 B1 8/2002 Seyffert
6,715,611 B2 4/2004 Crabbe
6,845,868 B1 * 1/2005 Krush ..... B07B 1/42 209/332
7,000,776 B2 2/2006 Winkler
7,175,027 B2 2/2007 Strong
7,216,767 B2 5/2007 Schulte
7,278,540 B2 10/2007 Stone
7,331,469 B2 2/2008 Padalino
7,571,817 B2 8/2009 Scott
7,954,644 B2 6/2011 Lease
8,118,172 B2 2/2012 Burnett
9,023,275 B2 5/2015 McClung
2007/0108105 A1 5/2007 Burnett
2007/0108106 A1 5/2007 Burnett
2008/0078703 A1 * 4/2008 Robertson ..... B07B 1/4627 209/397
2009/0230029 A1 * 9/2009 Bailey ..... B07B 1/46 209/408
2014/0217002 A1 * 8/2014 Holton ..... E21B 21/065 210/232
2017/0058621 A1 * 3/2017 Bailey ..... B07B 1/46
2018/0214798 A1 * 8/2018 Cady ..... B01D 39/12

* cited by examiner

*Primary Examiner* — Michael McCullough
*Assistant Examiner* — Kalyanavenkateshware Kumar
(74) *Attorney, Agent, or Firm* — Egbert, McDaniel & Swartz, PLLC

(57) ABSTRACT

A vibrator separator system has a vibrator separator position and a vibratory basket, a screen assembly positioned in the vibratory separator, and a vibration amplifier coupled to the vibratory separator. The vibratory basket has sides arranged in spaced relation to each other. The vibratory separator has at least one motor affixed thereto. The screen assembly extends between an inlet end and a discharge end of the vibratory basket. The motor is cooperative with the screen assembly so as to impart a vibration frequency to the screen assembly. The vibration amplifier is positioned beneath the screen assembly. The vibration amplifier is cooperative with the screen assembly so as to exert a force against a portion of an underside of the screen assembly.

19 Claims, 7 Drawing Sheets

HIGH G FORCE VIBRATORY SEPARATOR SYSTEM

CROSS-REFERENCE TO RELATED APPLICATIONS

Not applicable.

BACKGROUND OF THE INVENTION

1. Field of the Invention

The present invention relates to apparatus for screening a mixture of fluids and solids. More particularly, the present invention relates to a vibratory separator having an vibration amplifier system for the purpose of increasing G forces on the screen assembly.

2. Description of Related Art Including Information Disclosed Under 37 CFR 1.97 and 37 CFR 1.98

Vibrating screens have been employed for many years to separate particles in a wide array of industrial applications. One common application of vibrating screens is in drilling operations to separate particles suspended in drilling fluids. The screens are mounted generally horizontally on a vibrating mechanism or shaker that imparts a desired motion to the screen. Material from which particles are to be separated is poured onto a back end of the vibrating screen usually from a pan mounted above the screen. The material generally flows toward the front end of the screen. Large particles are unable to move through the screen remain on top of the screen and move toward the front of the screen where they are collected. The smaller particles and fluid flows through the screen and collects in a tank, receptacle or pan beneath the screen.

Typically, a vibrating screen is resiliently suspended or mounted upon a support and is caused to vibrate by a vibrating mechanism, e.g. an unbalanced weight on a rotating shaft connected to a basket or frame. The screen is vibrated by vibratory equipment to create a flow of trapped solids on top surfaces of the screen for removal and disposal of solids. The fineness or coarseness of the mesh of a screen may vary depending upon mud flow rate and the size of the solids to be removed.

The need for solids control in drilling mud used in hydrocarbon well drilling is well-known in the prior art. Drilling mud, typically a mixture of clay and water and various additives, is pumped down through a hollow drill string (pipe, drill collar, bit, etc.), into a well being drilled and exits through holes in a drill bit. The mud picks up cuttings (rock) and other solids from the well and carries them upwardly away from the bit and out of the well in a space between the well walls and the drill string. At the top of the well, the solids-laden mud is discharged over a shale shaker, a device which typically has a screen or a series of screens arranged in tiered or flat disposition with respect to each other. The prior art discloses a wide variety of vibrating screens, devices which use screens, shale shakers, and screens for shale shakers. The screens catch and remove solids from the mud as the mud passes through them. If drilled solids and/or debris are not removed from the mud used during the drilling operation, recirculation of the drilled solids can create weight, viscosity, and gel problems in the mud, as well as increasing wear on pumps and other mechanical equipment used for drilling.

A conventional type of vibratory separator comprises a screen assembly driven by two electric or hydraulic motors with unbalanced weights on the end of the motor of the drive shaft of the motors. The drive shafts rotate in opposite directions. The location of the motors facilitates the transference of G forces generated by the motors to the screen assembly. These G-forces generate a vibratory motion pattern and constant acceleration. When the slurries or solids are fed to the screen assembly, the G forces decrease, thereby limiting the amount of energy required to produce an efficient separation. Accordingly, by increasing the G-forces, heavier loads may be processed, fluid capacity may be increased, and separation efficiency may also be increased.

In mineral processing applications, vibratory separators or high-frequency vibrating screens separate solids in different sizes or solids from a liquid phase depending on the size and shape of the screen openings. Typically, the high-frequency vibrating screen is an angled basket operating between 900 and 1800 rpm with G-forces in the range of four to seven G's. The vibrating screen has an orbital or linear motion at a fixed vibration angle.

In other applications, such as oil well drilling, vibratory separators or shale shakers remove certain large particles while allowing certain smaller particles to remain in the fluid. The large particles include drilled solids. The smaller particles may include drilling fluid additives. The screen assembly on the shale shakers determines the size of the solids to be removed based on the size and shape of the screen openings. The efficiency of the separation is also affected by parameters such as fluid flow rates, particle size and drilling fluid properties, including viscosity, density and solids content. Typically, the shale shaker is a horizontal basket operating at between 1200 to 18 rpm with G-forces in the range of five to seven G's, with a linear or balanced elliptical motion and a fixed vibration angle.

Typically, in the mineral processing industry, the operating parameters that affect screening or separation efficiency are constant, thus the design parameters of the vibratory separator are fixed. However, when the operating parameters change, such as in oil well drilling, for example, they could adversely affect overall system performance or separation efficiency, leading to solids and/or liquid bypassing and machine overload. One solution to this problem is the manual adjusting of the screen assembly angle, known as "deck angle". A drawback of this solution, however, is that at deck angles greater than 3°, solids grinding, or degradation, can be a problem. Another known solution is to simply install a coarser mesh on the discharge end. Both solutions are sometimes unsatisfactory, however, since they are both subjective and involve human error. As such, there is a need that exist for a method and apparatus for screening with higher G-forces to ensure an efficient operation.

In the past, various patents have issued relating to such vibratory screening systems. For example, an early patent is that of U.S. Pat. No. 3,899,414, issued on Aug. 12, 1975 to L. T. Hansen. This patent describes a vibratory screen separator having an arcuate plate which receives sediment from a plurality of hydrocyclones and distributes the sediment to the separator screen. The arcuate plate collects the sediment from a plurality of discharge positions and presents it to a centrally positioned outlet where it can fall onto a separator screen. The arcuate plate is itself positioned on the vibratory screen separator and is caused to vibrate therewith. The arcuate plate in combination with a grate over the centrally positioned outlet also provides a cover for the separator to prevent large objects from damaging the screen.

U.S. Pat. No. 6,269,953, issued on Aug. 7, 2001 to Seyffert et al., discloses a vibratory separator screen assembly which has at least two ridge-valley series of screening material with a plurality of alternating ridges and valleys of screening material. There is at least one flat area of screening material adjacent to the ridge-valley series.

U.S. Pat. No. 6,401,934, issued on Jun. 11, 2002 to Largent et al., teaches a ramped screen and vibratory separator system. The screen assembly has a base, at least one layer of screening material on the base, and at least one ramp formed in the layer of screening material.

U.S. Pat. No. 6,439,391, issued on Aug. 27, 2002 to K. W. Seyffert, shows a vibratory separator apparatus for separating components of a fluid stream fed to the vibratory separator apparatus. The vibratory separator apparatus has a separator apparatus for separating components of the fluid material stream and a heating apparatus for heating the fluid material stream.

U.S. Pat. No. 6,715,611, issued on Apr. 6, 2004 to Crabbe et al., provides a vibratory separator for separating components of material introduced thereto. The vibratory separator is a shale shaker. The vibratory separator includes a basket for holding the screening apparatus. The basket has two sides spaced-apart at a first end at which the material is introduced into the basket and a second end spaced away from the first end. Components separated from the material exit the basket from the second end. A vibrating apparatus is connected to the basket for vibrating the basket. The screening apparatus is mounted in the basket. The screening apparatus has at least a first portion and a second portion. The first portion is at the first end of the screen and is lower in the basket than the second portion. A receptacle is below the screening apparatus for receiving material components flowing through the screening apparatus.

U.S. Pat. No. 6,845,868, issued on Jan. 25, 2005 to Krush et al., describes a vibratory separator which includes a multi-frequency vibratory adapter system that converts the single frequency vibration into multiple-frequency vibrations of the screen or sieve surface. The peak acceleration caused by the multi-frequencies at least an order of magnitude greater than the main frequency acceleration. A disadvantage of the system is the generation of frequencies that are out-of-phase. This is detrimental to the conveyance of solids.

U.S. Pat. No. 7,000,776, issued on Feb. 21, 2006 to Winkler et al., teaches a screen assembly for vibratory separators. The screen assembly includes a first screen portion having a first end and a second end spaced away from the first end. A second screen portion is adjacent to the second end of the first screen portion. The second screen portion projects downwardly from the second end of the first screen portion.

U.S. Pat. No. 7,175,027, issued on Feb. 13, 2007 to Strong et al., discloses a screen assembly and a vibratory separator. The vibratory separator serves to separate components of material introduced therein. The vibratory separator includes a basket, a collection receptacle beneath the basket and a deck on the basket for mounting the screen assembly thereon. The deck has a plurality of deck pins projecting upwardly therefrom. A screen assembly is positioned on the deck. The screen assembly includes screening material. The screening material has a plurality of openings therethrough suitable for the flow of fluid therethrough. The screening material has a plurality of spaced-apart screen holes therethrough. A holding apparatus is provided for holding the screen assembly on the deck with a part of a deck pin in each screen hole.

U.S. Pat. No. 7,216,767, issued on May 15, 2007 to Schulte et al., teaches a screen basket and shale shaker. The screen mounting basket for a vibratory separator serves to separate components of material introduced into the basket. The vibratory separator includes a collection receptacle beneath the basket. The basket includes two opposed spaced-apart side walls having first ends and second ends. The first ends are spaced-apart by spaced-apart end walls connected to each of the side walls. A basket bottom is located between the two spaced-apart side walls. At least one screen assembly is positioned vertically in the basket for intercepting material introduced into the basket and for screening this material. The screen assembly extends from one side wall of the basket to the other.

U.S. Pat. No. 7,278,540, issued on Oct. 9, 2007 to Stone et al., discloses a vibratory separator having a base, a basket movably mounted on the base for supporting a screen apparatus for treating material introduced into the vibratory separator. The basket is located on a base and is pivotable with respect thereto. The vibratory apparatus is connected to the basket for vibrating the basket. The screen apparatus is supported by the basket. An angle adjustment apparatus is connected to the basket for adjusting an angle of the basket. A sensor senses a parameter indicative of basket angle and provides a signal corresponding to this basket angle. A control apparatus receive signals from the sensor apparatus and controls the basket angle based upon the signals. The angle adjustment apparatus includes a rocker arm assembly with a first pivotable end.

U.S. Pat. No. 7,331,469, issued on Feb. 19, 2008 to Padalino et al., discloses a vibratory separator with an automatically adjustable beach. The vibratory separator has a basket for supporting a screen apparatus for treating material. The basket is pivotally mounted on a base. The vibratory apparatus is connected to the basket for vibrating the basket. A beach is formed on the screen apparatus. A measurement device is connected to the basket and positioned above the screen for measuring a distance from the measurement apparatus to a top surface of the pool. A control apparatus controls and communicates with the measurement apparatus for receiving signals therefrom which is indicative of a pool depth. An adjustment apparatus is used for adjusting the angle of the basket and adjusting the extent of the beach.

U.S. Pat. No. 7,571,817, issued on Aug. 11, 2009 to Scott et al., provides an automatic separator or shaker with an electromagnetic vibrator apparatus. This vibratory separator has a base, a basket movably mounted on the base, a screen on the basket, in which a least a portion of the screen is not inclined downhill. An electromagnetic vibratory apparatus is connected to the basket for vibrating the basket in the screen apparatus. A driving apparatus drives the electromagnetic vibratory apparatus. The control apparatus controls the driving apparatus and the electromagnetic vibratory apparatus.

U.S. Pat. No. 7,954,644, issued on Jun. 7, 2001 to Lease et al., teaches a separator system having a first trough having an inlet end, a downstream outlet end and a trough floor. A first screen section is supported in the trough and is spaced from the trough floor. The first screen section has a first end at the second downstream end. A material-retaining surface is disposed at the downstream end of the first screen section. The material-retaining surface is disposed at an angle relative to the first screen section in order to limit the movement of material across the first screen section. A vibratory generator is coupled to the trough.

U.S. Pat. No. 8,118,172, issued on Feb. 21, 2012 to G. A. Burnett, shows a shale shaker with cartridge screen assembly. The screening apparatus includes a vibratable box connected via vibration isolators within a container. The box includes a screening apparatus thereon. The vibratory separator has replaceable screening cartridges within a container.

U.S. Pat. No. 9,023,275, issued on May 5, 2015 to G. L. McClung, provides shale shakers and separators with real-time monitoring of operation. A killing apparatus serves to kill living things in a fluid flowing from the separator or shaker. A heating apparatus is provided for heating the material fed into or flowing from the separator or shaker.

U.S. Patent Application Publication No. 2007/0108105, published on May 17, 2007 to G. A. Burnett, discloses an upflow shaker and separator. In particular, the separator system includes a container, a screen apparatus with a box, and at least one screen on the box. The screen has a plurality of holes therethrough through which the liquid is passable and through which the solids are not passable. A vibratory apparatus vibrates the box and the screen. The material to be treated is flowable up to the screen and liquid in the material as flowable to and through the screen. A primary conveyor is located beneath the screen for removing solids from liquid.

U.S. Patent Application Publication No. 2007/0108106, published on May 17, 2007 to G. A. Burnett, provides a vibratory separator system including a basket for containing material to be treated by vibratory action. The screen apparatus in the basket screens solids from the material. The screening apparatus includes a screen support with at least one screen through which liquid in the material is passable and through which solids in the material are not passable. A first vibratory apparatus is secured to the screen support for vibrating the screen support and thereby vibrating the screen. A second vibratory apparatus is connected to the screen for vibrating the screen.

It is an object of the present invention to provide a vibratory separator system that applies increased G-forces during the screening process.

It is another object of the present invention to provide a vibratory separator system that is effective across a variety of sizes of particles.

It is another object of the present invention to provide a vibratory separator system that is able to process heavier loads.

It is another object of the present invention to provide a vibratory separator system that can increase fluid capacity.

It is another object of the present invention to provide a vibratory separator system that increases separation efficiencies.

It is a further object of the present invention to provide a vibratory separator system that avoids human error and subjective judgment.

It is another object of the present invention to provide a vibratory separator system that is adjustable to control G-forces on the screen assembly.

It is still further object of the present invention to provide a vibratory separator system that is capable of generating G-forces in the range of between ten and thirty G's.

It is another object of the present invention provide a vibratory separator system that is less prone to clogging or binding.

It is still a further object of the present invention to provide a vibratory separator system that has increased strength so as to be able to withstand G-forces.

It is still further object of the present invention to provide a vibratory separator system that ensures optimum performance.

These and other objects and advantages of the present invention will become apparent from a reading of the attached specification and appended claims.

BRIEF SUMMARY OF THE INVENTION

The present invention is vibrator separator system that comprises a vibratory separator positioned in a vibrating basket, a screen assembly positioned in the vibratory separator, and a vibration amplifier coupled to the vibratory separator. The vibratory basket has sides arranged in spaced relation to each other. The vibratory separator has at least one motor affixed thereto. The vibratory basket has an inlet end and a discharge end. The screen assembly extends between the inlet end and the discharge end of the vibratory basket. The motor is cooperative with a screen assembly so as to impart a vibration frequency to the screen assembly. The vibration amplifier is positioned beneath the screen assembly. The vibration amplifier is cooperative with the screen assembly so as to exert a force against a portion of an underside of the screen assembly.

In the present invention, the motor is an electric motor or a hydraulic motor. In particular, the motor can include a pair of motors that are affixed to the vibratory basket so as to exert vibrations to the screen assembly positioned in the vibratory separator.

At least one pressure wedge clamps the screen assembly to the vibratory separator. In particular, the screen assembly comprises a plurality of screen assemblies arranged in end-to-end relation within the vibratory basket. The pressure wedge comprises a plurality of pressure wedges respectively clamping the plurality of screen assemblies to the vibratory separator.

The screen assembly comprises a pre-tensioned frame clamped to the vibratory separator and a screen affixed within the pre-tensioned frame. The pre-tensioned frame has a pair of side bars in spaced parallel relation to each other and a pair of end bars extending between the pair of side bars and positioned at opposite ends of the pre-tensioned frame. The pre-tensioned frame has no ribs extending between the pair of side bars in an area between the pair of end bars.

The vibratory separator has a screen deck positioned in the vibratory basket. The screen deck receives the screen assembly thereon.

The vibration amplifier includes a housing coupled to the vibratory separator, a flexible mass mounted inside the housing, and a beater bar coupled to the flexible mass. The vibration amplifier is in contact with a central portion of the screen assembly. The beater bar contacts or bears against the screen assembly so as to keep the screen assembly under tension. The vibration amplifier extends over no more than 40% of a total area of the screen assembly. The vibration amplifier is in phase with the vibration frequency of the vibratory separator. The screen deck has a support. The rigid housing is affixed with fasteners to the support. The housing has a mounting base that is secured to mounts bolted to a frame of the vibratory basket. The flexible mass has a thickness of between one and four inches. The flexible mass is formed of a material selected from the group consisting of an elastomer, a plastic material and a seal material.

A rigid center piece can be positioned within a hollow interior of the flexible mass. The beater bar is mounted to a top of the rigid plate connected to the flexible mass. The beater bar is retained by a fastener and spaced from the rigid plate. The beater bar has at least a pair of flexible strips retained by rivets or bolts and glued to the beater bar. An additional weight can be removably affixed to the rigid center piece.

The beater bar can comprise a pair of rigid bars extending in parallel relation to each other. The pair of flexible strips are respectively affixed to a top of the pair of rigid bars. The screen assembly has a pre-tensioned frame of the screen assembly is adapted to resist a striking force of the beater bars at G-forces in a range of between ten and thirty G's.

The present invention is also an improved method and apparatus for screening. The present invention comprises a vibratory separator driven by two drive motors having respective out-of-balance weights arranged to produce acceleration. There are one or more vibration amplifiers located beneath the screen assembly so as to enhance the separation efficiency by providing higher G-forces on the screen assembly.

The vibration amplifier includes a flexible mass mounted inside a rigid frame. The rigid frame is mounted on a screen basket which transmits motion to the flexible mass. The flexible mass is coupled to a beater bar which strikes the screen assembly with a high G-force. The flexible mass of each amplifier has a relatively high amplitude in the direction perpendicular to the screen assembly.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
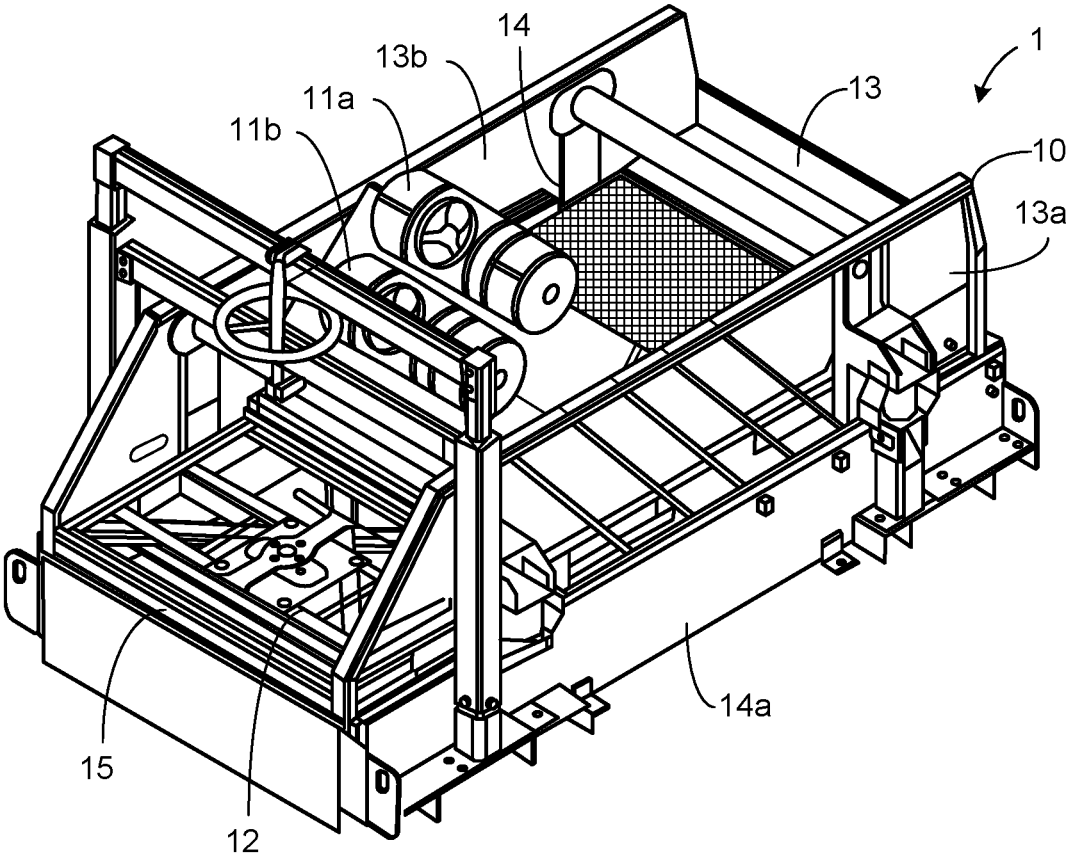
FIG. 1 is an isometric view of the vibratory separator apparatus in accordance with the present invention.

Referring to FIG. 1, there is shown the vibratory separator system 1 in accordance with the teachings of the preferred embodiment of the present invention. This vibratory separator system 1 can be extensively used in the industry for diverse applications in mineral processing, food, pharmaceutical, oil and gas, environmental and chemical industries. Typical size separations range from 300 millimeters down to 30 micrometers. Dry operation is generally limited to material above five millimeters in sizes. Wet operations down to around 70 micrometers is common. In FIG. 1, the vibratory separator system 1 of the present invention includes a vibratory basket 10, vibrating motors 11*a* and 11*b* and the vibration amplifier 12. The vibratory separator system 1 receives a slurry via an inlet end 13. The slurry is transferred and separated along the screen assembly 14 by a vibratory motion. The solids larger than the size of the screen openings are discharged from the discharge end 15. The remaining portions of the slurry are discharged from the bottom of the vibratory basket 10.

In FIG. 1, it can be seen that the vibratory basket 10 has sides 13*aa* and 13*b* arranged in parallel planar relationship to each other. Each of the sides 13*a* and 13*b* extends from the inlet end 13 toward the discharge end 15. The screen material will similarly extend from the inlet end 13 toward the discharge end 15. For the purposes of illustration, a portion of the screen 15 has been omitted so as to more clearly illustrate the vibration amplifier 12. The vibratory basket 10 is positioned on a skid 14*d*. Skid 14*d* facilitates the ability for the vibratory separator system 1 to be transported to a desired location. Motors 11*a* and 11*b* are conventional vibratory screen motors which are designed with out-of-center weights on a shaft on an interior thereof. The motors 11*a* and 11*b* can be mounted to the side 13*b* of the vibratory basket 10 so as to impart vibratory motion to the basket 10 and to the screen 14 positioned therein.

Figure 2A:
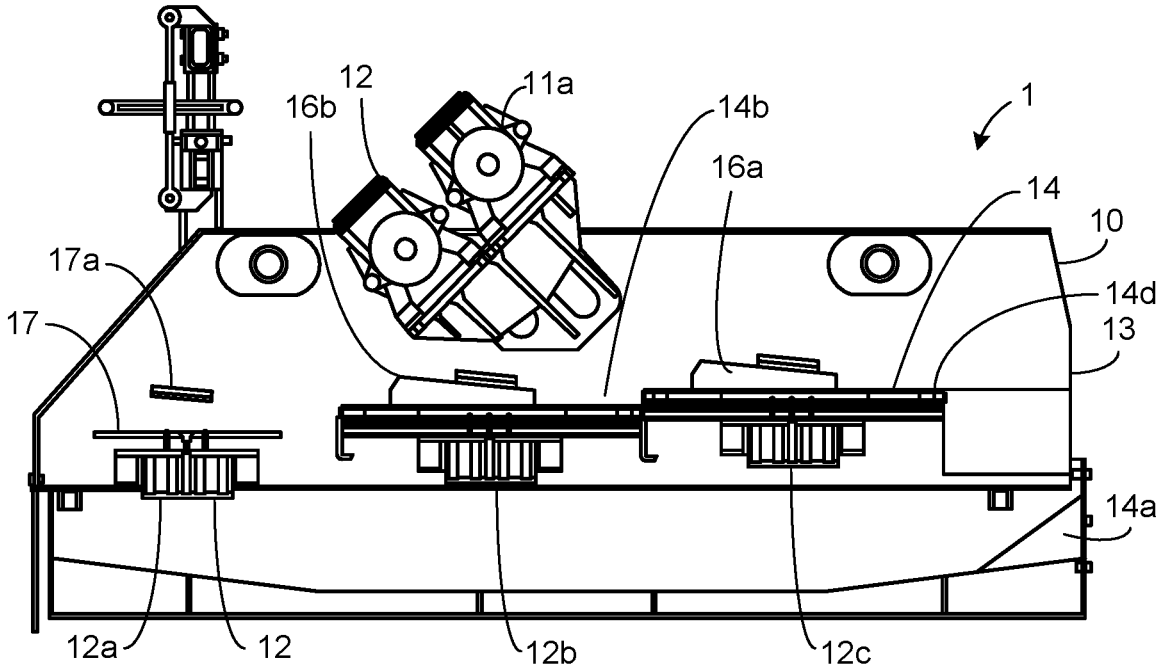
FIG. 2A is a side cross-sectional view of the screen separator of FIG. 1 showing the vibration amplifier system in accordance with one embodiment of the present invention.

FIG. 2A shows the vibratory basket 10 having a generally flat screen assembly 14 therein. Screen assembly 14 is comprised of multiple sections 14*d* and 14*b* (along with additional screen sections), as necessary. Screen sections 14*d* and 14*b* are positioned in end-to-end relationship with screen section 14*b* slightly lower than screen section 14*d*. A slurry will enter the inlet end 13 of the vibratory basket 10 and will be processed over the screen assembly 14. Each of the sections 14*d* and 14*b* of screen assembly 14 are fastened to the vibratory basket 10 with pressure wedges 16*a* and 16*b*. The vibratory basket 10 is provided with one or more vibration amplifiers 12 located below the screen assembly 14 in order to amplify the G-forces on the screen assembly 14.

In particular, FIG. 2A shows vibration amplifier 12 as having specific vibration amplifiers 12*a*, 12*b* and 12*c*. It can be seen that vibration amplifier 12*b* will act on the screen assembly 14*b*. Vibration amplifier 12*c* will act on screen assembly 14*d*. Vibration amplifier 12*a* is illustrated as away from any of the screen assemblies. Typically, when in use, another screen assembly would be placed upon a screen deck 17. Another pressure wedge (such as pressure wedges 16*a* and 16*b*) would be would bear against such a screen by way of an angled strut 17*a*. Any number of flat screens can be used depending on upon the requirements of the vibratory basket 10. The present invention operates equally well regardless of the number of such screen assemblies.

FIG. 2A also shows the location of the motors 11*a* and 11*b* as positioned at an upper location on the vibratory basket 10. The vibratory screen apparatus 10 of the present invention is further illustrated as mounted on skid 14.

Figure 2B:
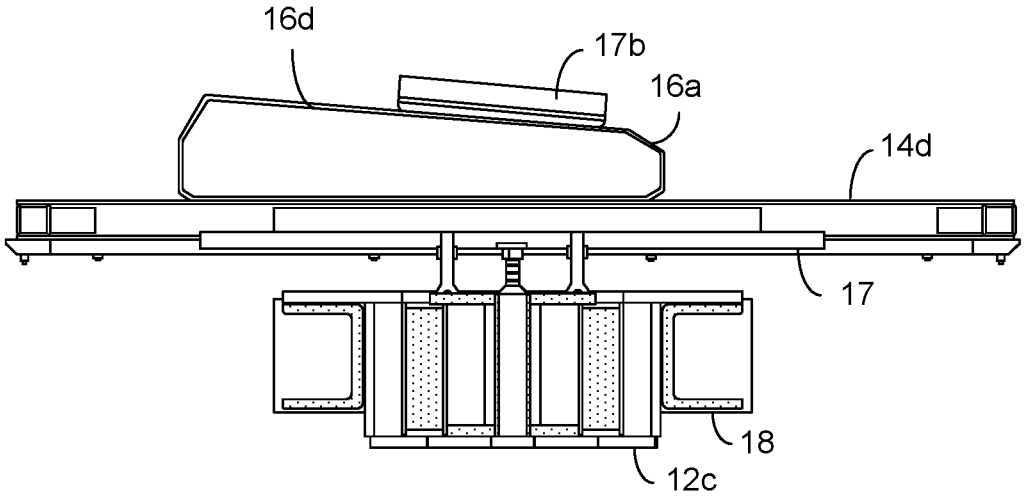
FIG. 2B is a side cross-sectional view of the screen separator of FIG. 1 showing the vibration amplifier system in accordance with one embodiment of the present invention.

As shown in FIG. 2B, a screen 14*d* is particularly illustrated. The configuration of the remaining screens would be similar to that shown in FIG. 2B. Screen 14*d* is provided with vibration amplifier 12*c* for applying a high G-force beneath a portion of the screen 14*d*. A clamping system, such as pressure wedge 16*a*, secures the screen assembly 14*d* to the vibratory basket 10. The vibration amplifier 12*c* is designed to strike the underside of the screen assembly 14*d* to increase the efficiency of operation as fluids and particles pass over the screen assembly 14*d*. A high G-force, in the range of ten to thirty G's, encourages the passage of fluids and particles smaller than the screen openings. The length of a beater bar 17 is designed to strike a relatively small area on the underside of the screen assembly 14*d*. The area of contact between the beater bar 17 and the screen assembly 14*d* should be less than 40% of the total area of the screen assembly 14*d*, and preferably in the order of 20% to 30% of the total screen area. The vibration amplifier 12*c* is coupled to the frame 18 and is preferably bolted thereto.

FIG. 2B shows that the pressure wedge for 16*a* will bear against the screen assembly 14*d*. Angled strut 17*b* will engage with a top surface 16*d* of the pressure wedge 14 so as to cause pressure wedge 16*a* to forcibly bear against the screen assembly 14*d*.

Figure 3:
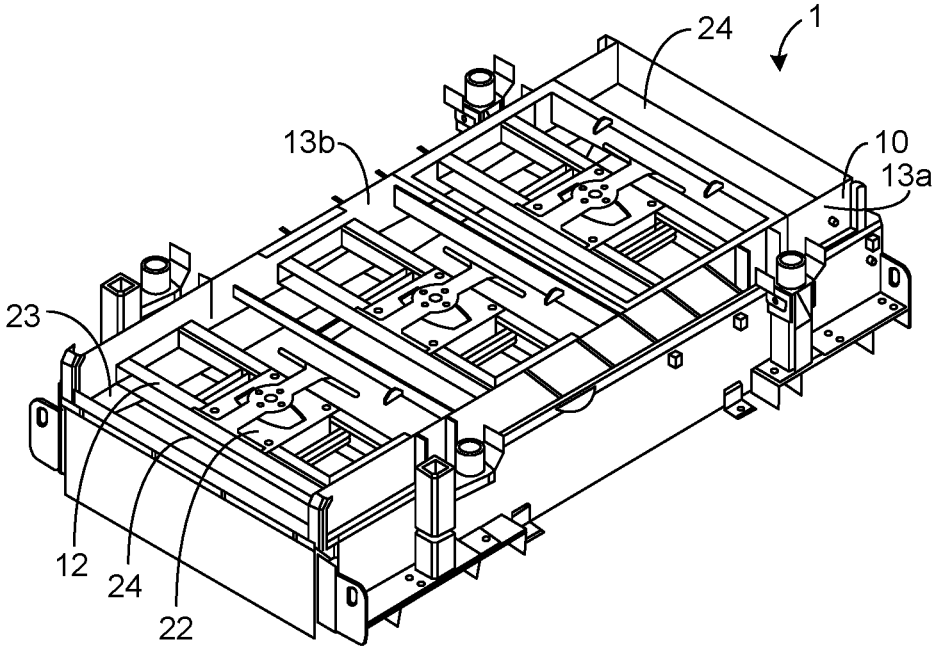
FIG. 3 is a cut-away view of the screen separator of FIG. 1 showing the vibration amplifier system in accordance with the one embodiment of the present invention.

FIG. 3 shows the vibratory basket 10 of the vibratory separator apparatus 1 as having side walls 13*a* and 13*b*. There are one or more screen decks between the side walls 13*a* and 13*b*. There are supports 22 for the vibration amplifier 12. The vibratory basket 10 includes a pair of rigid longitudinally extending side beams 23. A pair of transverse end beams 24 lie in respective planes parallel to each other so as to bridge the ends of the longitudinal side beams 23. As such, the frame is basically rectangular. The ends of the supports 22 are rigidly secured, normally by welding, to the side walls 13*a* and 13*b*.

Figure 4:
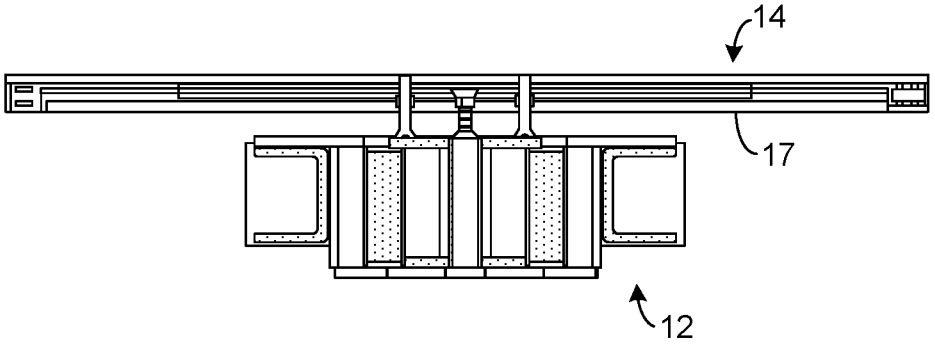
FIG. 4 is a side cross-sectional view of the screen separator shown in FIG. 1 and, in particular, showing the vibration amplifier system and the screen assembly in accordance with this one embodiment of the present invention.

As can be seen in FIG. 4, the screen assembly 14 is placed on top of the beater bar 17. The distance between the screen assembly 14 and the beater bar 17 should be zero in order to keep screen assembly 14 under tension so that the frequency of the vibration amplifier 12 is in phase with the frequency of the vibratory basket 10. The screen assembly 14 is preferably a pre-tensioned screen so that the amplified vibration is effectively transmitted to the solids slurry and the solids are conveyed easily downstream.

Figure 5:
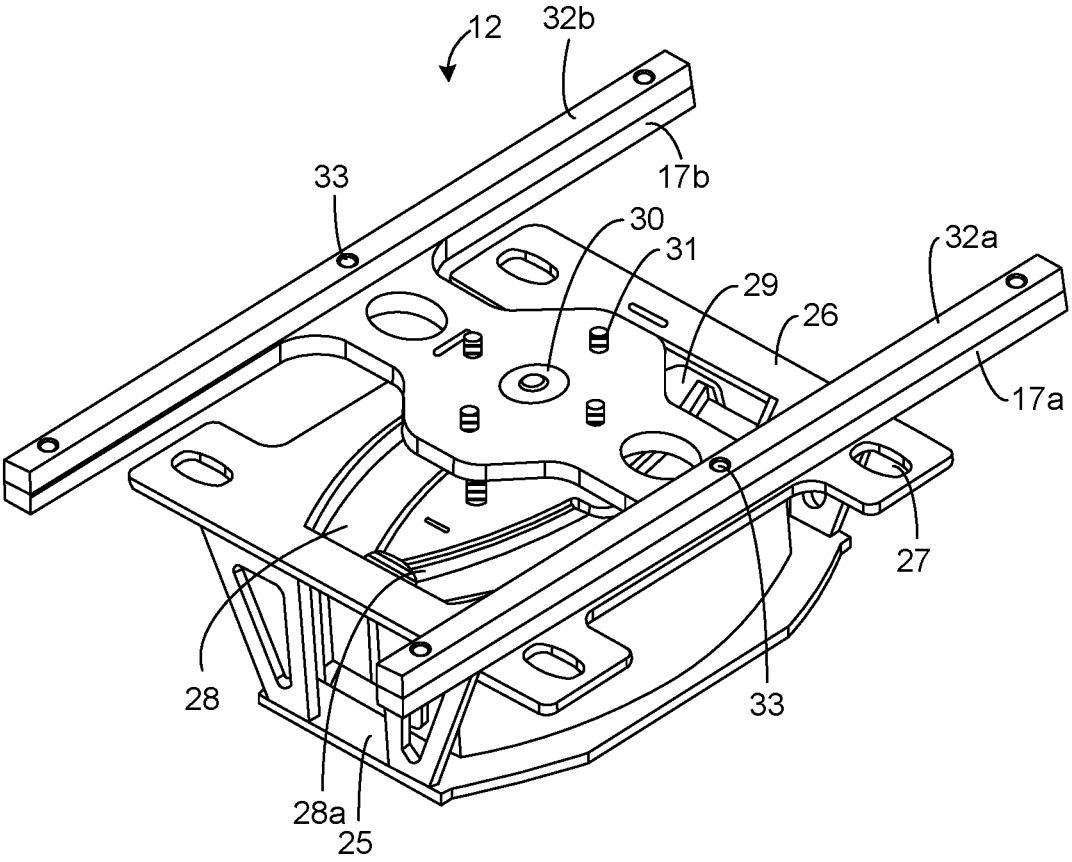
FIG. 5 is an isometric view from a top of the vibration amplifier system in accordance with the present invention.

FIG. 5 shows the vibration amplifier 12 as having a rigid housing 25 and beater bars 17*a* and 17*b*. The rigid housing 25 has an inner case mounting base 26 including holes 27. Holes 27 enable the vibration amplifier 12 to be secured to mounts bolted to the frame of the vibratory basket 10. The rigid housing 25 has a flexible mass 28 mounted inside the rigid housing 25. The flexible mass 28 has a thickness in the range of one to four inches and is made of a shock-absorbing material, such as an elastomer, a soft plastic, and a seal material. The flexible mass 28 has a hollow interior 28*a* suitable for receiving a rigid center piece 29. The beater bars 17*a* and 17*b* are mounted on top of the rigid center piece 29. The beater bars 17*a* and 17*b* are retained by bolt 30 and spaced from the rigid plate 29 with bolt or set screws 31 and locking nuts (not illustrated). The beater bars 17*a* and 17*b* have respective flexible strips 32*a* and 32*b* which are retained by respective rivets or bolts 33. The flexible strips 32*a* and 32*b* can be glued to the beater bars 17*a* and 17*b*. The flexible strips 32*a* and 32*b* are made of a shock-absorbing material, such as an elastomer or plastic.

Figure 6:
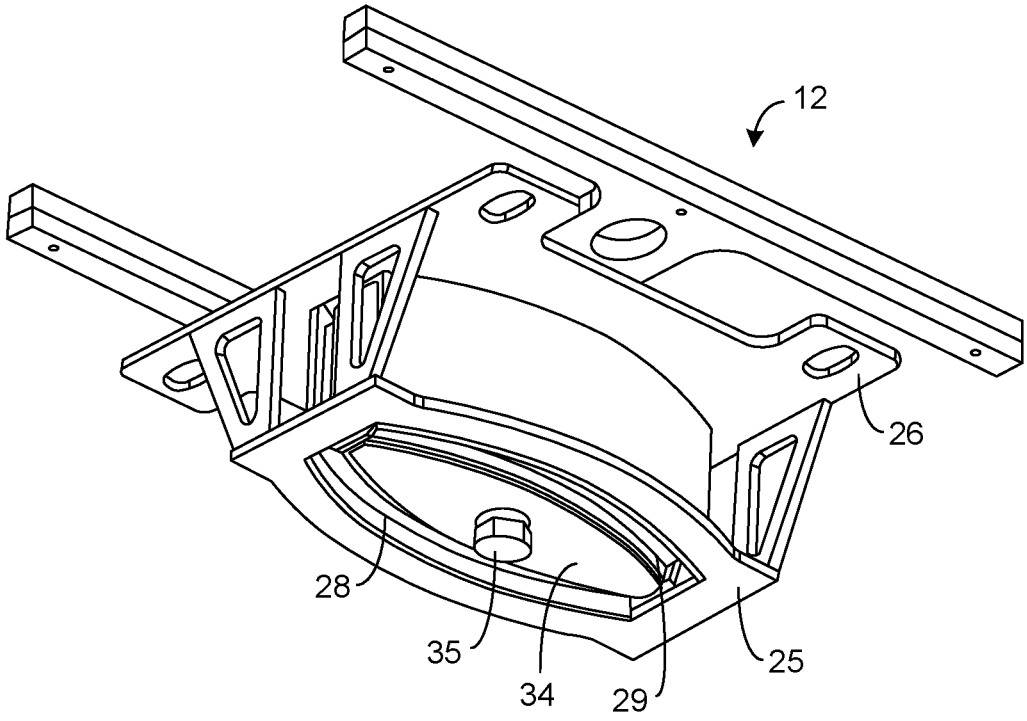
FIG. 6 is an isometric view from the bottom of the vibration amplifier system in accordance with the present invention.

FIG. 6 shows an underside of the vibration amplifier 12. In particular, it can be seen that additional weights 34 can be coupled to the rigid bottom plate 29. A nut or bolt 35 is used to secure the additional weights 34. This additional weight can be applied to increase the G-forces on the screen assembly, as required. Additionally, FIG. 4 further illustrates the flexible member 28 as extending around the periphery of the bottom rigid plate 29. The rigid housing 25 extends to mounting base 26.

Figure 7:
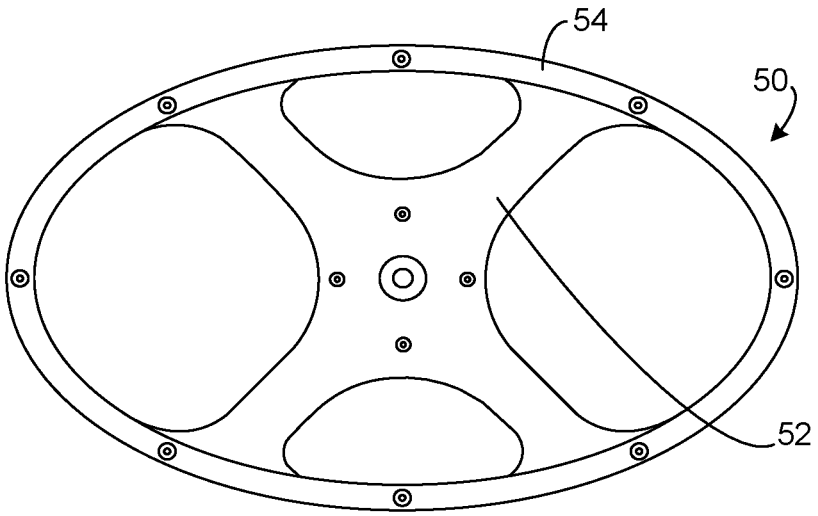
FIG. 7 is a plan view of a beater bar with an elliptical shape in accordance with an alternative embodiment of the present invention.

FIG. 7 shows an alternative embodiment of a beater bar 50. As can be seen, beater bar 50 has a generally overall or elliptical configuration. A central portion 52 engages the peripheral beater bar portion 54. The beater bar portion 54 can engage with the underside of the screen assembly for providing the requisite forces thereto.

Figure 8:
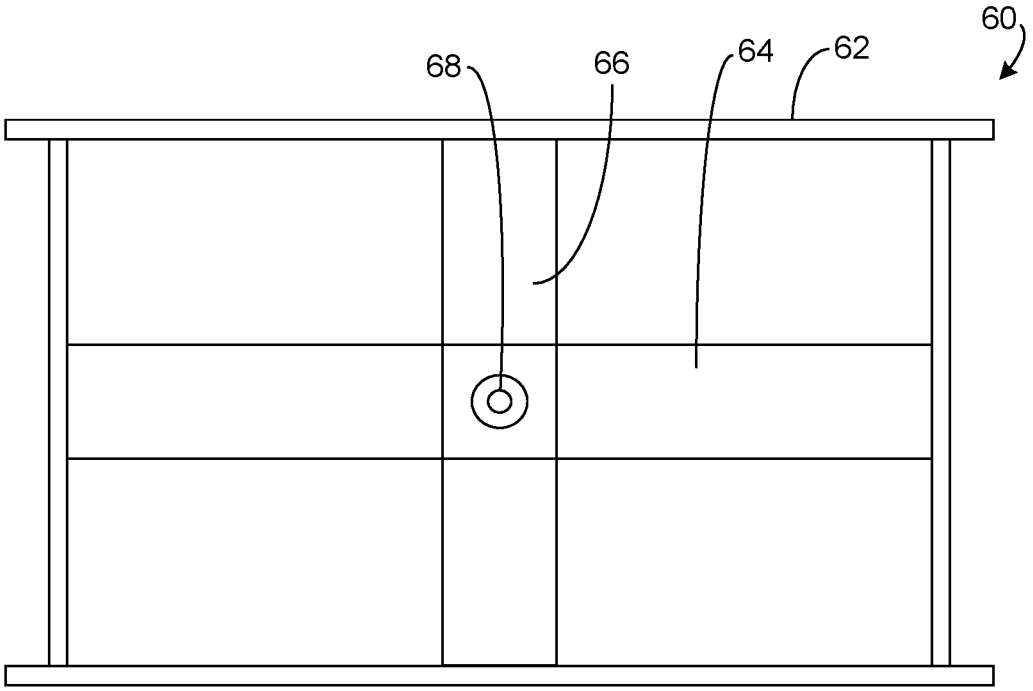
FIG. 8 is a plan view showing the beater bar with a rectangular shape in accordance with a further alternative embodiment of the present invention.

FIG. 8 shows an alternative embodiment 60 of the beater bar 62 of the vibration amplifier. It can be seen that the beater bar portion 62 in the embodiment 60 has a generally rectangular configuration. The rectangular configuration includes a central strut 64 and a transverse strut 66 that are secured together by a bolt 68. It should be noted that the beater bar portion of the vibration amplifier can take on a wide variety of other configurations.

Figure 9:
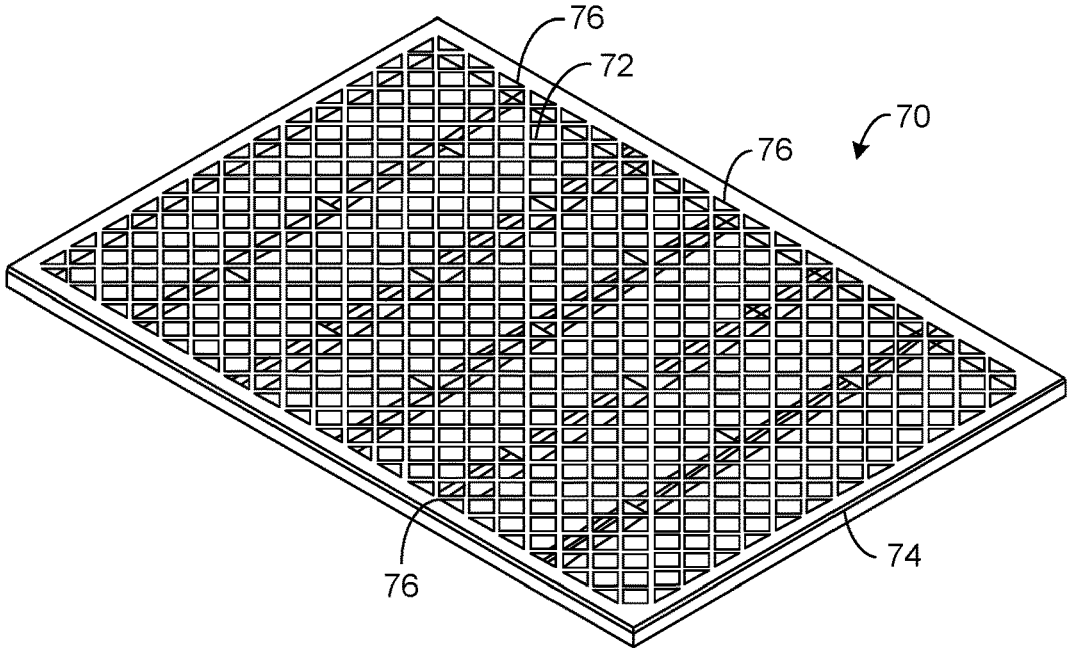
FIG. 9 PRIOR ART
FIG. 9 is an isometric view of a screen assembly in accordance with the prior art.

FIG. 9 illustrates a prior art screen assembly 70. Screen assembly 70 has one, two or three layers of screening mesh or screen cloth 72 which can be bonded together and supported on a four-sided support or metal frame 74 with a perforated plate used between the mesh or cloth. The frame 74 can include one or more cross members 76 extending across the frame 74 and connected at the ends to sides of the frame. The screen assembly 70 is designed to withstand G-forces in the range of five to seven G's. They must be capable of transmitting the G-forces to the feed slurry or solids.

Figure 10:
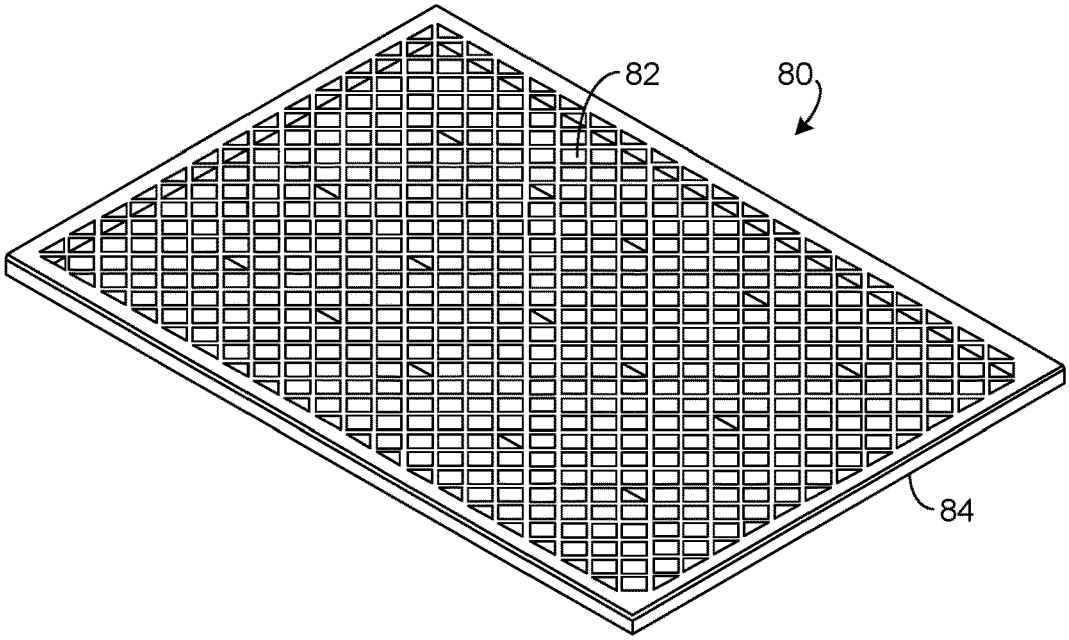
FIG. 10 is an isometric view of the screen assembly in accordance with the teachings of the present invention.

FIG. 10 shows the pre-tensioned screen assembly 80 in accordance with the teachings of the present invention. This pre-tensioned screen assembly 80 should resist the striking force of the beater bar at higher G-forces in the range of ten to thirty G's. It can be seen that there is a screen material 82 that is retained within a screen frame 84. The screen frame 74 and screen 82 has to be very rigid and lightweight. The ribs (as shown in FIG. 9) have been removed so that they will not interfere with the striking force of the beater bar. The frame 84 will be formed of a high-strength steel.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A vibrator separator system comprising:

a vibratory separator positioned in a vibratory basket, the vibratory basket having sides arranged in spaced relation to each other, said vibratory separator having at least one motor affixed thereto, said vibratory basket having an inlet end and a discharge end;

a screen assembly positioned in said vibratory separator, said screen assembly extending between the inlet end and the discharge end of the vibratory basket, the at least one motor being cooperative with said screen assembly so as to impart a vibratory frequency to said screen assembly; and a vibration amplifier coupled to said vibratory separator, said vibration amplifier positioned beneath said screen assembly, said vibration amplifier cooperative with said screen assembly so as to exert a force against a portion of an underside of said screen assembly, said vibratory separator having a screen deck positioned in said vibratory basket, the screen deck receiving said screen assembly therein, said vibration amplifier comprising:
a housing coupled to said vibratory separator;
a flexible mass mounted inside said housing; and
a beater bar coupled to said flexible mass.

2. The vibratory separator system of claim 1, the at least one motor being an electric motor or a hydraulic motor.

3. The vibratory separator system of claim 2, the at least one motor comprising a pair of motors affixed to the vibratory basket so as to exert vibrations to said screen assembly positioned in said vibratory separator.

4. The vibratory separator system of claim 1, further comprising:
at least one pressure wedge clamping said screen assembly to said vibratory separator.

5. The vibratory separator system of claim 4, said screen assembly comprising a plurality of screen assemblies arranged in end-to-end relation within the vibratory basket, said at least one pressure wedge comprising a plurality of pressure wedges respectively clamping the plurality of screen assemblies to said vibratory separator.

6. The vibrator separator system of claim 1, said screen assembly comprising:
a pre-tensioned frame clamped to said vibratory separator; and
a screen affixed within said pre-tensioned frame.

7. The vibrator separator system of claim 6, said pre-tensioned frame having a pair of side bars in spaced parallel relation to each other and a pair of end bars extending between the pair of side bars and positioned at opposite ends of said pre-tensioned frame, said pre-tensioned frame having no ribs extending between the pair of side bars in an area between the pair of end bars.

8. The vibrator separator system of claim 1, said vibration amplifier being in contact with a central portion of said screen assembly, said beater bar contacting or bearing against the screen assembly so as to keep the screen assembly under tension.

9. The vibrator separator system of claim 1, said vibration amplifier extending over no more than 40% of a total area of said screen assembly.

10. The vibrator separator system of claim 1, the screen deck having a support, said housing being affixed with fasteners to the support.

11. The vibrator separator system of claim 1, wherein said housing has a mounting base that is secured to a mount bolted to a frame of the vibratory basket.

12. The vibrator separator system of claim 1, said flexible mass having a thickness of between one and four inches, said flexible mass formed of a material selected from the group consisting of an elastomer, a plastic, and a seal material.

13. The vibrator separator system of claim 1, further comprising:
a rigid center piece positioned within a hollow interior of said flexible mass.

14. The vibrator separator system of claim 13, further comprising:
an additional weight removably affixed to said rigid center piece.

15. The vibrator separator system of claim 1, wherein said beater bar is mounted to a top of a rigid plate connected to said flexible mass, said beater bar being retained by a fastener and spaced from the rigid plate.

16. The vibrator separator system of claim 1, wherein said beater bar has at least a pair of flexible strips retained by rivets or bolts and glued to said beater bar.

17. The vibrator separator system of claim 16, said beater bar comprising a pair of rigid bars extending in parallel relation to each other, the at least a pair of flexible strips being respectively affixed to a top of the pair of rigid bars.

18. The vibrator separator system of claim 1, said screen assembly having a pre-tensioned frame, the pre-tensioned frame being adapted to resist a striking force of said beater bar at G forces in a range of between ten and thirty G's.

19. A vibrator separator system comprising:
a vibratory separator positioned in a vibratory basket, the vibratory basket having sides arranged in spaced relation to each other, said vibratory separator having at least one motor affixed thereto, said vibratory basket having an inlet end and a discharge end;
a screen assembly positioned in said vibratory separator, said screen assembly extending between the inlet end and the discharge end of the vibratory basket, the at least one motor being cooperative with said screen assembly so as to impart a vibratory frequency to said screen assembly; and
a vibration amplifier coupled to said vibratory separator, said vibration amplifier positioned beneath said screen assembly, said vibration amplifier cooperative with said screen assembly so as to exert a force against a portion of an underside of said screen assembly, said vibration amplifier having a vibration frequency in phase with the vibration frequency of said vibratory separator.

* * * * *